US010501251B1

(12) United States Patent
Chen

(10) Patent No.: US 10,501,251 B1
(45) Date of Patent: Dec. 10, 2019

(54) TRAMPOLINE PACKAGING SYSTEM

(71) Applicant: Samuel Chen, Causeway Bay (CN)

(72) Inventor: Samuel Chen, Causeway Bay (CN)

( * ) Notice: Subject to any disclaimer, the term of this patent is extended or adjusted under 35 U.S.C. 154(b) by 0 days.

(21) Appl. No.: 16/182,413

(22) Filed: Nov. 6, 2018

(51) Int. Cl.

| | |
|---|---|
| ***B65D 85/20*** | (2006.01) |
| ***B65D 77/06*** | (2006.01) |
| ***B65D 81/20*** | (2006.01) |
| ***B65D 5/64*** | (2006.01) |
| *A63B 5/11* | (2006.01) |

(52) U.S. Cl.
CPC ..... *B65D 77/062* (2013.01); *B65D 5/64* (2013.01); *B65D 81/2023* (2013.01); *A63B 5/11* (2013.01)

(58) Field of Classification Search
CPC .... B65D 5/64; B65D 77/062; B65D 81/2023; A63B 5/11
USPC ..... 206/315.1, 524.8, 579; 482/27
See application file for complete search history.

(56) References Cited

U.S. PATENT DOCUMENTS

| | | | | |
|---|---|---|---|---|
| 4,339,123 | A * | 7/1982 | Rich | A63B 5/11 403/205 |
| 4,951,818 | A * | 8/1990 | Johnson | A45C 5/14 190/107 |
| 5,730,281 | A * | 3/1998 | Powell | B65D 5/5028 135/136 |
| 8,474,640 | B2 * | 7/2013 | Armstrong | A45C 7/0081 220/23.89 |
| 2004/0121883 | A1 * | 6/2004 | Publicover | A63B 5/11 482/29 |
| 2005/0194031 | A1 * | 9/2005 | Goldwitz | E04H 15/44 135/128 |
| 2006/0270524 | A1 * | 11/2006 | Colling | A63B 5/11 482/27 |

* cited by examiner

*Primary Examiner* — Luan K Bui
(74) *Attorney, Agent, or Firm* — Clement Cheng

(57) ABSTRACT

A trampoline packaging system has a box base with a box cover. A left footing stack is arranged from a plurality of left leg footings. The leg footings have a rear left leg bend and a front left leg bend. A right footing stack is arranged from a plurality of right leg footings. The leg footings have a rear right leg bend and a front right leg bend. A walled area is formed between the left footing stack and the right footing stack. The walled area has a front hollow and a rear hollow. A first vacuum bag holds an enclosure net and a second vacuum bag holds trampoline spring covers.

10 Claims, 5 Drawing Sheets

TRAMPOLINE PACKAGING SYSTEM

FIELD OF THE INVENTION

The present invention is in the field of trampoline packaging.

DISCUSSION OF RELATED ART

Trampolines have been a popular backyard sports equipment staple providing fun and exercise for adults and children. As they are somewhat large, a variety of different methods have been used for packaging trampolines. For example, United States patent publication 2006/0270524 published Nov. 30, 2006 to inventor Michael J Colling describes a method for packaging and disassembled trampoline, the disclosure of which is incorporated herein by reference.

A variety of vacuum packing methods have been used for vacuum sealable bags. For example, U.S. Pat. No. 5,664,408 by inventor Chesterfield issued Sep. 9, 1997 entitled Apparatus For Vacuum Packaging A Soft Product, describes an apparatus for vacuum packing a soft product.

SUMMARY OF THE INVENTION

A trampoline packaging system has a box base with a box cover. The box cover fits over the box base. The box base has a right box flap and a left box flap. The box base has a rear box flap and a front box flap. The right box flap is connected to the rear box flap and the front box flap. The left box flap is connected to the rear box flap and the front box flap. A left footing stack is arranged from a plurality of left leg footings. The leg footings have a rear left leg bend and a front left leg bend. A right footing stack is arranged from a plurality of right leg footings. The leg footings have a rear right leg bend and a front right leg bend. A walled area is formed between the left footing stack and the right footing stack. The walled area has a front hollow and a rear hollow. A first vacuum bag holds an enclosure net and a second vacuum bag holds trampoline spring covers. The first vacuum bag is at least partially evacuated and the second vacuum bag is also partially evacuated. The first vacuum bag and the second vacuum bag are placed in the walled area.

The trampoline packaging system also has frame tubes arranged into a frame tube stack. The frame tube stack has a front frame tube stack cover and the rear frame tube stack cover placed in the walled area. The left footing stack has a first front leg stack cover and a second front leg stack cover and the right footing stack has a first right front leg stack cover and a second right front leg stack cover. The first vacuum bag has a bag valve port that is configured as a one-way port for extracting air from the first vacuum bag.

The front box flap has a front box flap left extension and a front box flap right extension. The front box flap left extension is parallel to and connects to the left box flap. The front box flap right extension is parallel to and connects to the right box flap. The rear box flap has a rear box flap left extension and a rear box flap right extension. The rear box flap left extension is parallel to and connects to the left box flap. The rear box flap right extension is parallel to and connects to the right box flap.

Figure 1:
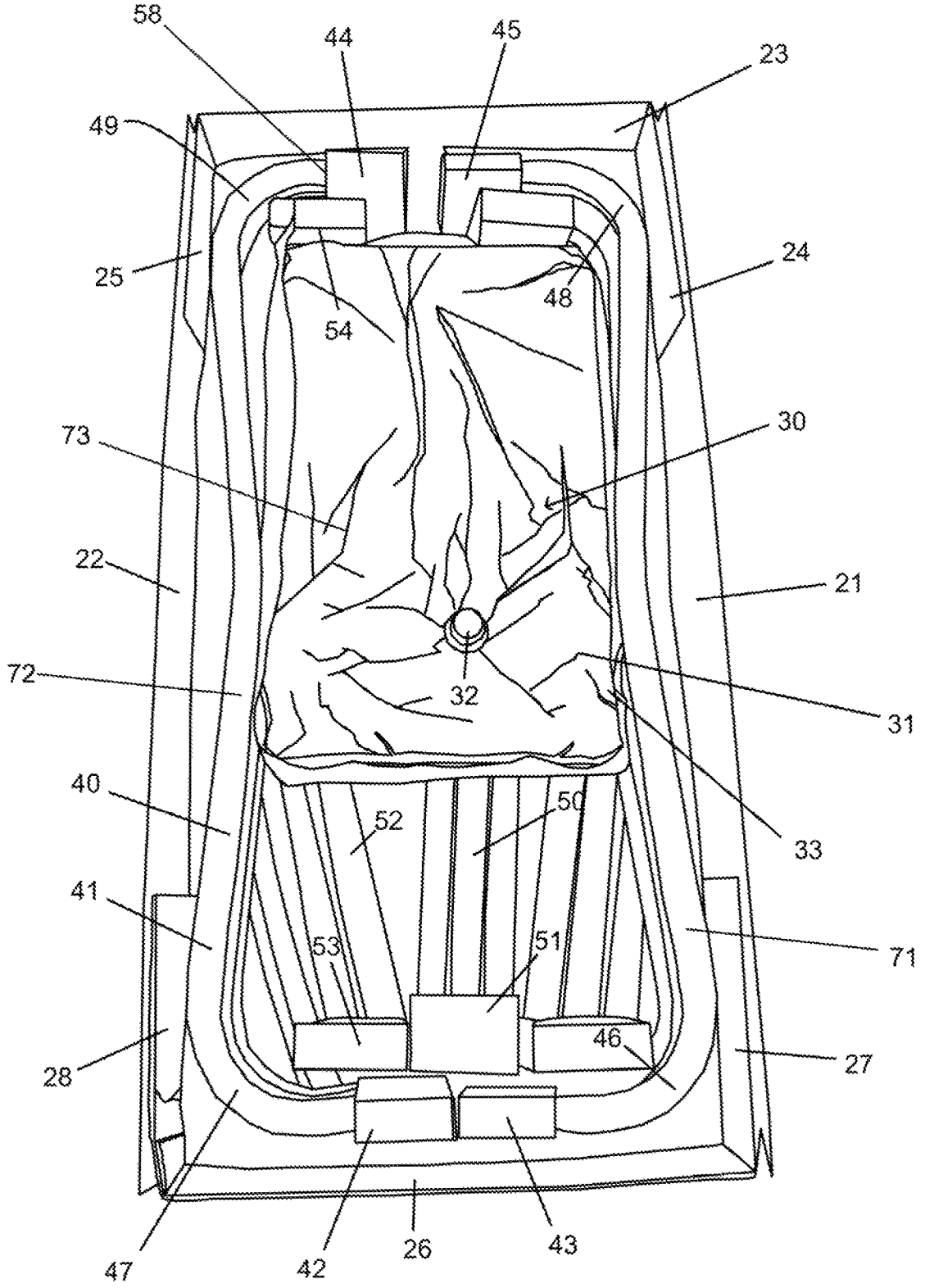
FIG. 1 is a partially packed trampoline box without the top cover.
Figure 2:
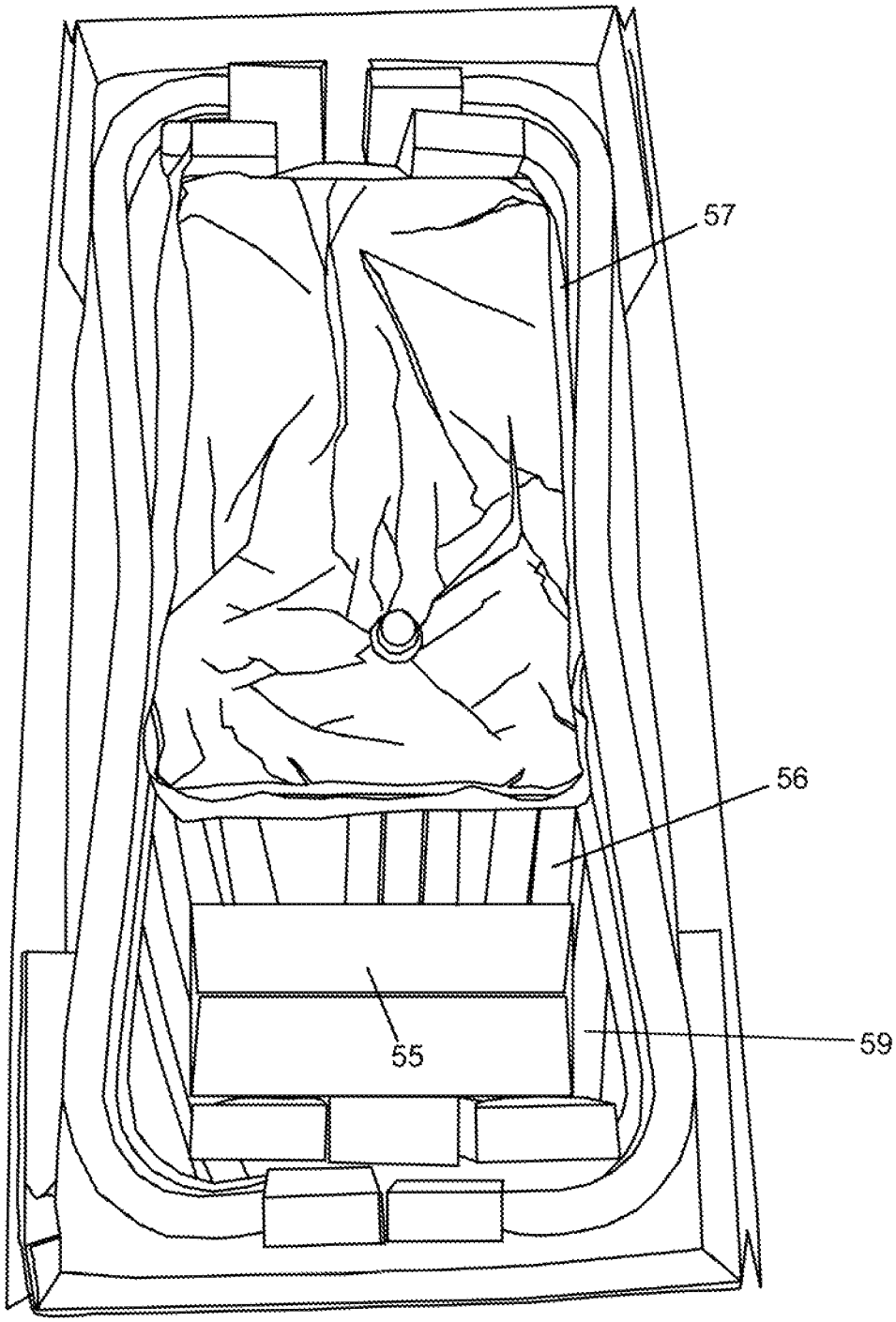
FIG. 2 is a partially packed trampoline box without the top cover and with additional parts not seen in FIG. 1.

The following call out list of elements can be a useful guide in referencing the element numbers in the drawings.

12 Box Base
13 Box Cover
21 Right Box Flap
22 Left Box Flap
23 Rear Box Flap
24 Rear Box Flap Right Extension
25 Rear Box Flap Left Extension
26 Front Box Flap
27 Front Box Flap Right Extension
28 Front Box Flap Left Extension
30 First Vacuum Bag
31 Bag Sidewall
32 Bag Valve Port
33 Enclosure Net
34 Second Vacuum Bag
35 Trampoline Spring Covers
36 Front Edge Of Spring Cover Bag
37 Rear Edge Of Spring Cover Bag
40 Leg Footing
41 Footing Stack
42 First Front Leg Stack Cover
43 Second Front Leg Stack Cover
44 Rear Leg Stack Cover
45 Second Leg Stack Cover
46 Front Right Leg Bend
47 Front Left Leg Bend
48 Rear Right Leg Bend
49 Rear Left Leg Bend
50 Enclosure Pole
51 Enclosure Pole Stack Cover
52 Frame Tubes
53 Front Frame Tube Stack Cover
54 Rear Frame Tube Stack Cover
55 Parts Box
56 Front Hollow
57 Rear Hollow
58 Leg Socketed Portion
59 Walled Area

DETAILED DESCRIPTION OF THE PREFERRED EMBODIMENT

As seen in the first figure, a trampoline packaging system includes a box and components placed in the box. The components are arranged in an optimal manner. The box has a lower portion and an upper portion. The lower portion is shown in the first figure. The first figure shows the box with a right box flap 21 and a left box flap 22. A rear box flap 23 has a rear box flap right extension and the rear box flap left extension 25. The box can be a corrugated cardboard box having a multilayer construction such as a pair of card stock sheets sandwiching a corrugated portion of the cardboard core.

The packaging system includes a front box right flap extension 27 extending from a front box flap 26. Similarly, a front box flap left extension 28 extends from the front box flap 26. The front box flap right extension 27 and the front box flap left extension 28 extended toward the rear box flap right extension 24 and the rear box flap left extension 25 such that the front box flap right extension is generally parallel to the rear box flap right extension 24, and the front box flap left extension 28 is generally parallel to the rear box flap left extension 25. The rear box flap 23 is generally parallel to the front box flap 26. Similarly, the left box flap 22 is generally parallel to the right box flap 21. The right box flap 21 and the left box flap 22 are elongated and are longer than the front box flap 26 and the rear box flap 23. The right box flap 21 and the left box flap 22 are more than twice as long as the front box flap 26 and the rear box flap 23.

The left box flap 22 and the right box flap 21 have an inside surface that can be glued to the flap extensions. The rear box flap right extension 24 has an outside surface that is glued or stapled to the right box flap 21 and the rear box flap left extension 25 has an outside surface that is glued or stapled to the left box flap 22. Similarly, the front box flap 26 has extensions that are connected to the left box flap 22 and the right box flap 21. The front box flap left extension 28 has an outside surface that can be glued or stapled to the left box flap 22. Similarly, the front box flap right extension 27 has an outside surface that can be stapled or glued to the right box flap 21.

The trampoline legs have a footing portion made in a bent U-shaped profile. The legs are made of tubular steel and include a leg footing 40. The leg footing 40 is connected to a pair of vertical tubular sections. The leg footing 40 has a pair of bends that contact the ground. The leg footing 40 has a rear left leg bend 49 and a front left leg bend 47. The rear left leg bend 49 and the front left leg bend 47 are spaced apart from each other and at a lower point than a rear left leg middle portion. Each of the rear left leg bend 49 and the front left leg bend 47 extend upwardly to a leg socketed portion.

The leg socketed portion 58 receives vertical tubes such as frame tubes 52. The leg footings 40 are stacked vertically in a footing stack 41. The footing stack has a first rear leg stack cover 44 that can be formed as a cardboard box or other type of enclosure or wrapping that covers the leg socketed portion 58 of the leg footing 40. The first rear leg stack cover 44 is vertically oriented similar to the first front leg stack cover 58. The first front leg stack cover 58 also covers leg socketed portions 58 of the leg footing 40, but towards the front left leg bend 47 rather than the rear left leg bend 49.

Analogously, the leg footing 40 can be stacked in a footing stack 41 on the right side of the box as well so that there are a pair of leg footing stacks. The leg footing stacks form a walled area 59 as seen in the second figure. The walled area 59 is rectangular shaped and is bounded by the box flaps. The box flaps enclose the vertical portion of the box and analogously, the walled area 59 is an enclosure of the vertical portion of the contents within the walled area 59. The box flaps thus also vertically enclose the walled area 59, but don't enclose the horizontal planes of the walled area 59.

The right footing stack 71 is symmetrical to the left footing stack 72 and oriented in a mirror relationship to the left footing stack 72. The right footing stack 71 also has a pair of leg socketed portions 58 that receive a second rear leg stack cover 45 and a second front leg stack cover 43. The second rear leg stack cover 45 and the second front leg stack cover 43 can be attached to the footing stack by adhesive tape. The second rear leg stack cover 45 preferably opposes and can contact or abut to the first rear leg stack cover 44 when the leg stack covers are installed to the leg stacks. The second rear leg stack cover 45 and the first rear leg stack cover 44 can be taped together after assembly if necessary. Similarly, the second front leg stack cover 43 and the first front leg stack cover 42 can contact each other and can be taped together if necessary. The opposing leg stack covers have openings that oppose each other. The four leg stack covers are preferably rectangular in shape each having a leg stack receiving opening.

The walled area 59 includes a front Hollow 56 and a rear hollow 57. The front hollow 56 receives articles within it. The walled area 59 is filled first with straight tubes. The straight tubes are frame tubes 52. The frame tubes 52 are stacked into a frame tubes stack. The frame tubes stack has a pair of ends wrapped within a front frame tubes stack cover 53 and a rear frame tubes stack cover 54. The enclosure poles 50 are also stacked in a bundle with a pair of ends that are also covered in a pair of enclosure stack covers 51. The enclosure poles 50 are placed between the pair of stacks of frame tubes 52. A first stack of frame tubes and a second stack of frame tubes are placed to the left and right side of the stack of enclosure poles 50. The frame tubes 52 are arranged to lengthwise generally parallel to the enclosure poles 50.

Inside the walled area 59, and on top of the frame tubes 52 and enclosure poles 50 is the first vacuum bag 30. The first vacuum bag 30 has a bag side wall 31 and a the bag side wall 31 as it bag valve port 32. The enclosure net 73 is sealed within the first vacuum bag 30 and a hose is connected to the bag valve port 32 for evacuating air from the enclosure net 73. The first vacuum bag 30 then collapses as the air is sucked out of it. Although not all of the air is sucked out of the bag, the first vacuum bag 30 then decreases substantially in size and becomes a flat planar member that is rectangular and is fitted between the left footing stack 72 and the right footing stack 71 on top of the stack of enclosure poles 50, and the stack of frame tubes 52. The first vacuum bag could be made with a small leak so that the enclosure net expends slightly during transit to lodge itself more tightly against the upper surfaces of the frame tubes 52, the enclosure poles 50 and the left and right surfaces of the right footing stack 71 and the left footing stack 72.

Figure 3:
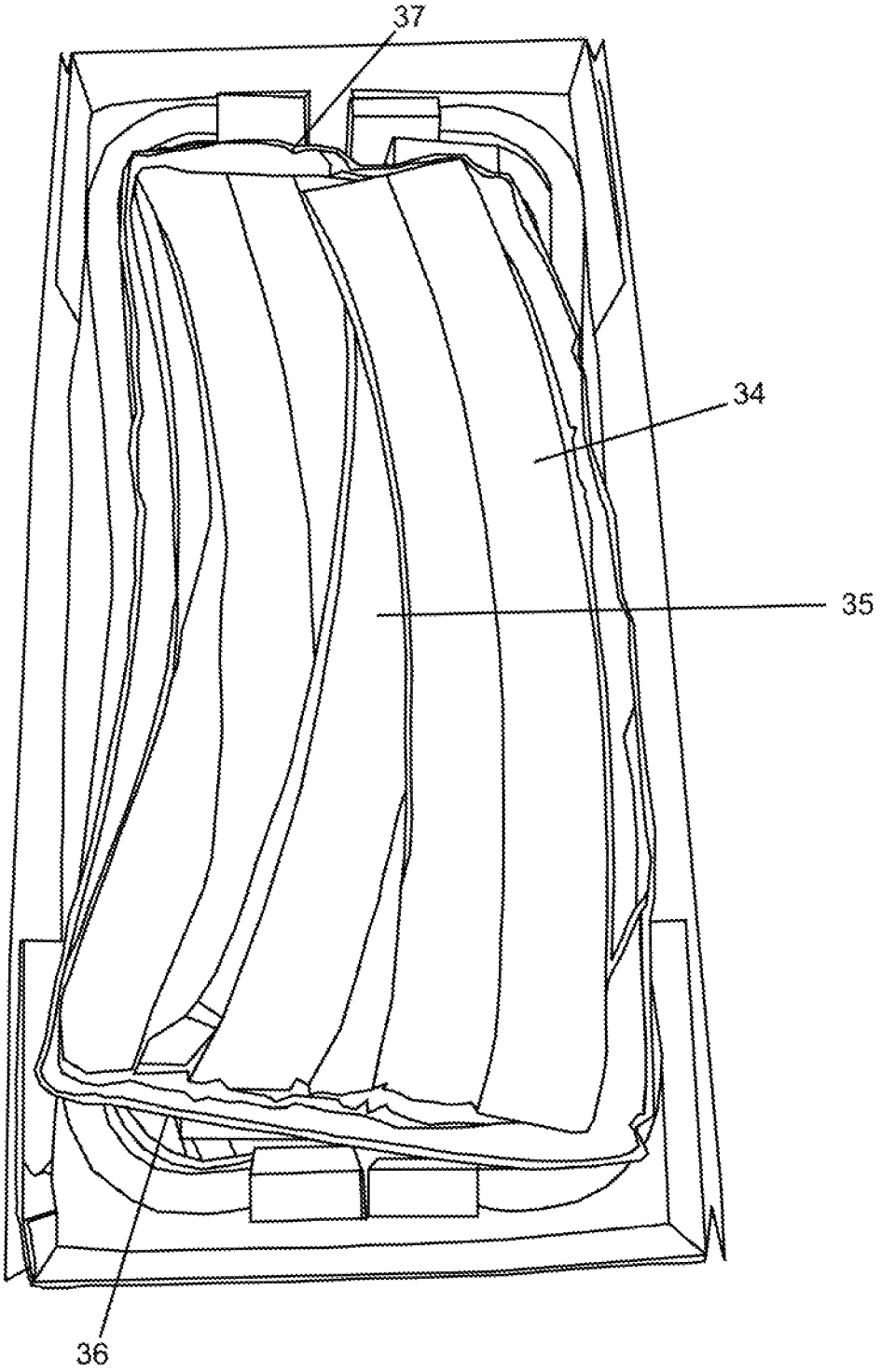
FIG. 3 is a packed trampoline box without the top cover.
Figure 4:
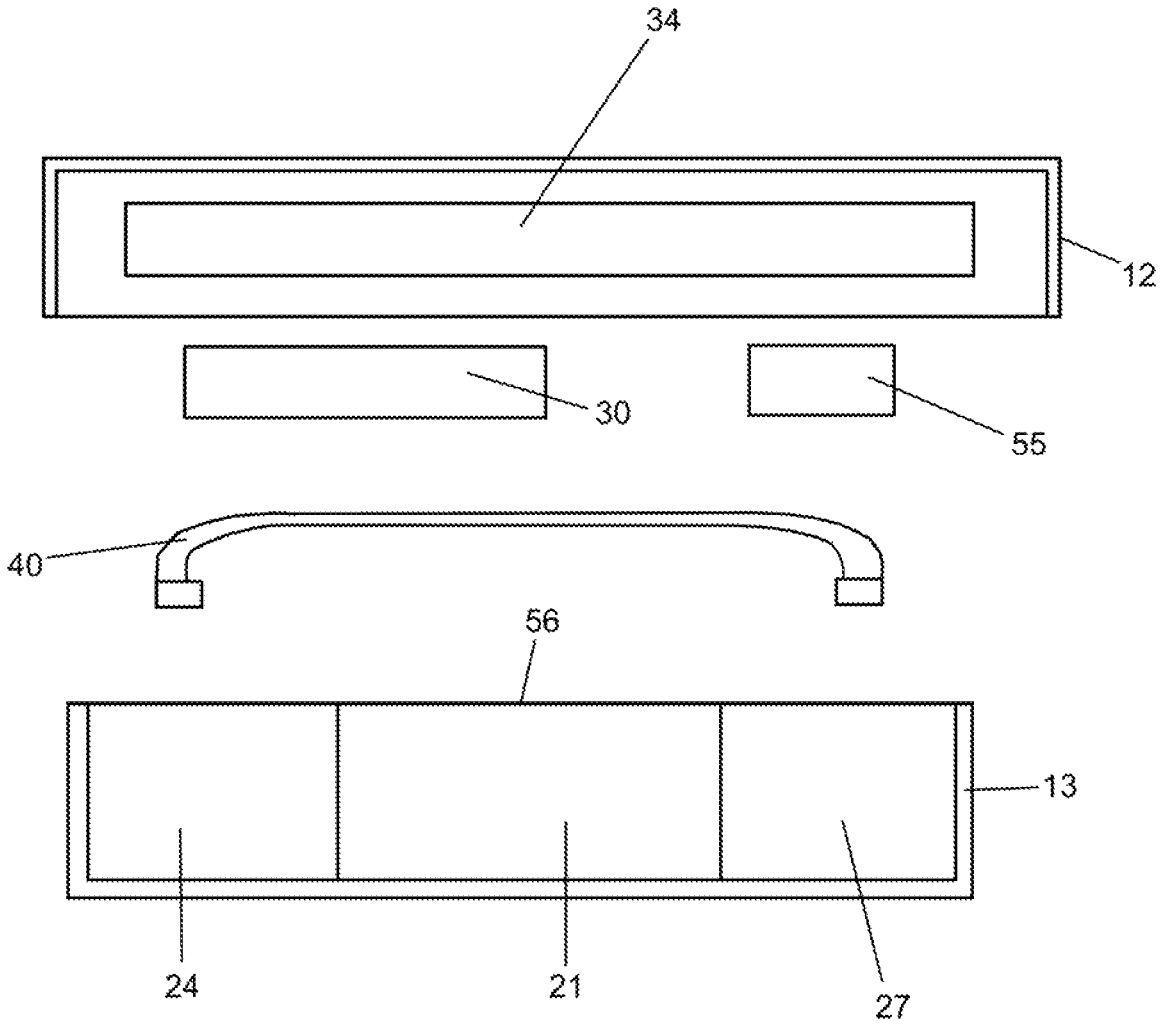
FIG. 4 is an exploded cross-sectional view of the present invention.
Figure 5:
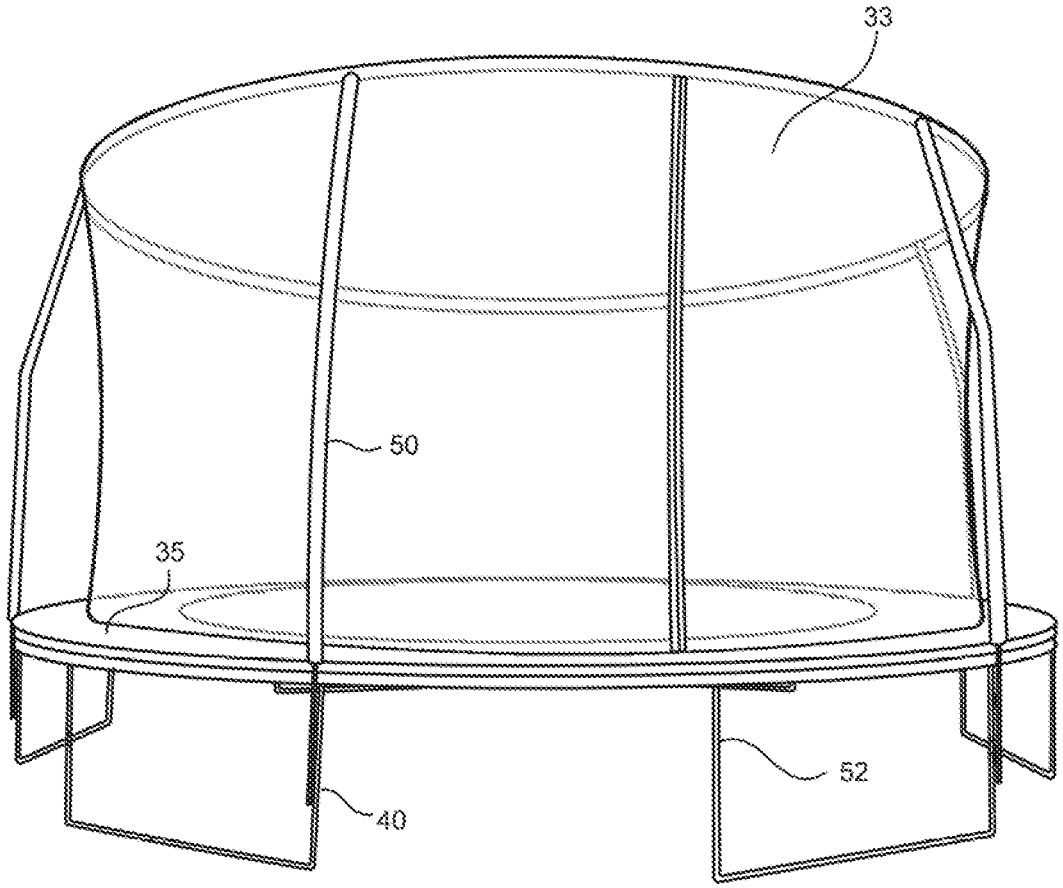
FIG. 5 is an assembled trampoline.

The first vacuum bag 30 is preferably placed in the rear hollow 57 and the front hollow 56 preferably receives a parts box 55. The parts box 55 can be springs and other mechanical connectors. The trampoline spring covers 35 as seen in FIG. 3 can be placed over the first vacuum bag 30 and the parts box 55. The trampoline spring covers 55 are also vacuum packed in a vacuum bag such as the second vacuum bag 34. The second vacuum bag 34 preferably also has a bag valve port 32. The rear edge of the spring cover bag 37 preferably is in the rear hollow 57 and the front edge of the spring cover bag 36 is preferably in the front hollow 56. The second vacuum bag 34 receives arc shaped sections of the spring cover. The arc shaped sections are distributed in a staggered pile so that when the spring covers 35 are put in the second vacuum bag, they can be arranged into a rectangular shape to be fairly distributed within the rectangular shaped second vacuum bag 34. The rectangular shaped second vacuum bag 34 fits within the rear hollow 57 and front hollow 56 of the walled area 59. The box cover fits over the rectangular shaped second vacuum bag 34.

The box has a box cover 12 fitting over a box base 13. The box base has the box flaps and the box flap extensions forming a container for the disassembled trampoline. The evacuated vacuum bags including the first vacuum bag 30 and the second vacuum bag 34. The vacuum bags are highly evacuated when initially loaded into the box. As the vacuum bags expand slightly, the soft portions of the spring cover padding and the net conform to the box contents within so as to act as packaging material. The box can be decreased in size compared to a regular box that does not have the vacuum packed bags. Additionally, packaging material that otherwise would act as a spring pressing against the contents within the box can be economized. The evacuated vacuum bags can act as a spring for preventing rattling of contents inside.

The invention claimed is:

1. A trampoline packaging system comprising:

a. a box base receiving a box cover, wherein the box cover fits over the box base, wherein the box base has a right box flap and a left box flap, wherein the box base has a rear box flap and a front box flap, wherein the right box flap is connected to the rear box flap and the front box flap, and wherein the left box flap is connected to the rear box flap and the front box flap;

b. a left footing stack arranged from a plurality of left leg footings, wherein the leg footings have a rear left leg bend and a front left leg bend;

c. a right footing stack arranged from a plurality of right leg footings, wherein the leg footings have a rear right leg bend and a front right leg bend;

d. a walled area formed between the left footing stack and the right footing stack, wherein the walled area has a front hollow and a rear hollow; and e. a first vacuum bag holding an enclosure net and a second vacuum bag holding trampoline spring covers, wherein the first vacuum bag is at least partially evacuated and wherein the second vacuum bag is also partially evacuated, wherein the first vacuum bag and the second vacuum bag are placed in the walled area.

2. The trampoline packaging system of claim 1, further including frame tubes arranged into a frame tube stack, wherein the frame tube stack has a front frame tube stack cover and the rear frame tube stack cover placed in the walled area.

3. The trampoline packaging system of claim 2, wherein the left footing stack has a first front leg stack cover and a second front leg stack cover and wherein the right footing stack has a first right front leg stack cover and a second right front leg stack cover.

4. The trampoline packaging system of claim 2, wherein the first vacuum bag has a bag valve port that is configured as a one-way port for extracting air from the first vacuum bag.

5. The trampoline packaging system of claim 2, wherein the front box flap has a front box flap left extension and a front box flap right extension, wherein the front box flap left extension is parallel to and connects to the left box flap, wherein the front box flap right extension is parallel to and connects to the right box flap.

6. The trampoline packaging system of claim 2, wherein the rear box flap has a rear box flap left extension and a rear box flap right extension, wherein the rear box flap left extension is parallel to and connects to the left box flap, wherein the rear box flap right extension is parallel to and connects to the right box flap.

7. The trampoline packaging system of claim 1, wherein the left footing stack has a first front leg stack cover and a second front leg stack cover and wherein the right footing stack has a first right front leg stack cover and a second right front leg stack cover.

8. The trampoline packaging system of claim 1, wherein the first vacuum bag has a bag valve port that is configured as a one-way port for extracting air from the first vacuum bag.

9. The trampoline packaging system of claim 1, wherein the front box flap has a front box flap left extension and a front box flap right extension, wherein the front box flap left extension is parallel to and connects to the left box flap, wherein the front box flap right extension is parallel to and connects to the right box flap.

10. The trampoline packaging system of claim 1, wherein the rear box flap has a rear box flap left extension and a rear box flap right extension, wherein the rear box flap left extension is parallel to and connects to the left box flap, wherein the rear box flap right extension is parallel to and connects to the right box flap.

* * * * *